US005801586A

United States Patent [19]

Ishizuka

[11] Patent Number: 5,801,586

[45] Date of Patent: Sep. 1, 1998

[54] CIRCUIT FOR SUPPLYING A REFERENCE LEVEL TO A DIFFERENTIAL SENSE AMPLIFIER IN A SEMICONDUCTOR MEMORY

[75] Inventor: Nobuhiko Ishizuka, Tokyo, Japan

[73] Assignee: NEC Corporation, Tokyo, Japan

[21] Appl. No.: 603,777

[22] Filed: Feb. 20, 1996

[30] Foreign Application Priority Data

Feb. 17, 1995 [JP] Japan ..... 7-053272

[51] Int. Cl.[6] ..... G05F 1/10

[52] U.S. Cl. ..... 327/545; 327/543; 327/143

[58] Field of Search ..... 327/143, 320, 327/321, 327, 328, 538, 540, 541, 545, 543, 530

[56] References Cited

U.S. PATENT DOCUMENTS

| | | | |
|---|---|---|---|
| 4,873,458 | 10/1989 | Yoshida | 307/362 |
| 5,132,565 | 7/1992 | Kuzumoto | 307/443 |
| 5,319,601 | 6/1994 | Kawata et al. | 365/226 |
| 5,424,629 | 6/1995 | Fujiwara et al. | 323/349 |
| 5,565,811 | 10/1996 | Park et al. | 327/546 |
| 5,627,493 | 5/1997 | Takeuchi et al. | 327/546 |

*Primary Examiner*—Timothy P. Callahan
*Assistant Examiner*—Jung Ho Kim
*Attorney, Agent, or Firm*—Young & Thompson

[57] ABSTRACT

A circuit for supplying a reference level to a differential sense amplifier in a semiconductor memory circuit, includes a first circuit for detecting an external power supply voltage, and a second circuit controlled by the first circuit, for controlling a reference level to be supplied to a sense amplifier, on the basis of the result of the detection of the external power supply voltage. Regardless of whether the external power supply voltage is a first power supply voltage (5 V) or a second power supply voltage (3 V), it is possible to output the reference level which can avoid occurrence of malfunction.

4 Claims, 4 Drawing Sheets

CIRCUIT FOR SUPPLYING A REFERENCE LEVEL TO A DIFFERENTIAL SENSE AMPLIFIER IN A SEMICONDUCTOR MEMORY

BACKGROUND OF THE INVENTION

1. Field of the Invention

The present invention relates to a semiconductor memory, and more specifically to a circuit for supplying a reference level to a differential sense amplifier in a semiconductor memory.

2. Description of Related Art

Referring to FIG. 1, there is shown a conventional reference amplifier part for supplying a reference level to a differential sense amplifier incorporated in a semiconductor memory. In FIG. 1, Reference Numerals 11 and 12 designate a P-channel transistor, and Reference Numerals 21, 22, 23, 24 and 25 indicate an N-channel transistor. Reference Numeral 3 shows a N-channel transistor having a low threshold voltage Vt, provided to maintain a reference level at a constant value. Reference Numeral 4 is indicative of a dummy cell, and Reference Numeral 5 designates an output node for supplying a reference level REF.

In brief, the P-channel transistors 11 and 12 and the N-channel transistor 21 are connected in series between a high potential power supply voltage $V_{DD}$ and ground in the named order, and a gate of each of the P-channel transistor 11 and the N-channel transistor 21 is connected in common to receive a chip enable signal $\overline{CE}$. A gate of the P-channel transistor 12 is connected to the ground. The N-channel transistor 22 is connected in parallel to the N-channel transistor 21, and a gate of the N-channel transistor 22 is connected to the dummy cell 4 and a drain of the N-channel transistor 23, which in turn has a gate connected to receive the chip enable signal $\overline{CE}$ and a source connected to the ground. The gate of the N-channel transistor 22 is connected to a source of the N-channel transistor 24, which in turn has a gate connected to a drain of the N-channel transistor 22 and a drain connected to the reference level output node 5. The N-channel transistor 25 is connected in the form of a load between the high potential power supply voltage $V_{DD}$ and the reference level output node 5. Namely, a source of N-channel transistor 25 is connected to the reference level output node 5, and a gate and a drain of the N-channel transistor 25 are connected in common to the high potential power supply voltage $V_{DD}$. In addition, three N-channel transistors 3 are connected, in parallel to each other, between the high potential power supply voltage $V_{DD}$ and the reference level output node 5. Each of the N-channel transistors 3 is connected in the form of a load. Namely, a source of each of the N-channel transistors 3 is connected to the reference level output node 5, and a gate and a drain of each of the N-channel transistors 3 are connected in common to the high potential power supply voltage $V_{DD}$. All of the three N-channel transistors 3 constitute a load circuit. The dummy cell 4 has the same construction as that of a memory cell (not shown) in the semiconductor memory, and is used for a reference cell.

Now, operation of the shown reference amplifier part of the differential sense amplifier will be described.

If a current flows through the dummy cell 4, a reference level REF outputted from the output node 5 is controlled to become a predetermined potential by action of the load circuit of the reference amplifier. Namely, if the chip enable signal $\overline{CE}$ is activated, namely is brought to a low level, the P-channel transistor 11 is turned on, and the N-channel transistors 21 and 23 are turned off, so that a gate potential of the N-channel transistor 24 is brought to a high level. Therefore, the N-channel transistor 24 is turned on, so that a current flows from the high potential power supply terminal $V_{DD}$ through the load circuit into the dummy cell 4. Thus, the reference potential REF is controlled to a constant value by action of the N-channel transistors 3 which act to make the reference level to a constant level.

Incidentally, in the example shown in FIG. 1, the gate of the P-channel transistor 12 is connected to the ground. But, the gate of the P-channel transistor 12 may be connected to the gate of the N-channel transistor 22.

The reference level REF outputted from the output node 5 is compared with a sense level appearing on a digit line (not shown) connected to a selected memory cell (not shown), by means of a sense amplifier (not shown), so that a difference between the reference level and the sense level is amplified and outputted from the sense amplifier.

In ordinary cases, assuming that an external power supply voltage $V_{DD}$ is a so called first power supply voltage (5 V), the reference level REF is set to an intermediate level between a high level (H) and a low level (L) of the sense level appearing on the digit line (not shown) connected to the selected memory cell (not shown), as shown in FIG. 2A. In other words, not only a difference between the reference level REF and the high level (H) of the sense level is substantially equal to a difference between the reference level REF and the low level (L) of the sense level, but also a predetermined sufficient margin is ensured between the reference level REF and each of the high level (H) and the low level (L) of the sense level, so that no malfunction occurs even if the sense level does not become constant because of a cause such as noise.

However, if the external power supply voltage $V_{DD}$ is a so called second power supply voltage (3 V), the margin between the reference level REF and each of the high level and the low level of the sense level becomes small, which substantially maintaining the relation that the difference between the reference level REF and the high level (H) of the sense level is substantially equal to the difference between the reference level REF and the low level (L) of the sense level. As a result, for example, as shown in FIG. 2B, if the high level of the sense level momentarily becomes lower than the reference level REF due to a noise or another cause, the high level is momentarily deemed to be the low level. Or, to the contrary, if the low level of the sense level momentarily becomes higher than the reference level REF, the low level is momentarily deemed to be the high level. Namely, the malfunction occurs.

SUMMARY OF THE INVENTION

Accordingly, it is an object of the present invention to provide a circuit for supplying a reference level to a differential sense amplifier, which has overcome the above mentioned defect of the conventional one.

Another object of the present invention is to provide a circuit for supplying a reference level to a differential sense amplifier, the circuit being configured to control the reference level so that the reference level never crosses the sense level, thereby to avoid a malfunction of the sense amplifier, even if a semiconductor memory circuit which internally has the differential sense amplifier and which normally operates when the external power supply voltage $V_{DD}$ is the first power supply voltage (5 V), is caused to operate with the second power supply voltage (3 V).

The above and other objects of the present invention are achieved in accordance with the present invention by a circuit for supplying a reference level to a differential sense amplifier in a semiconductor memory circuit, the circuit including a first circuit for detecting an external power supply voltage, and a second circuit controlled by the first circuit, for controlling a reference level to be supplied to a sense amplifier, on the basis of the result of the detection of the external power supply voltage.

With the above mentioned arrangement, regardless of whether the external power supply voltage is a first power supply voltage (5 V) or a second power supply voltage (3 V), it is possible to output the reference level which can avoid occurrence of malfunction.

In one embodiment, the second circuit is configured to selectively change a driving capacity of the second circuit on the basis of the result of the detection of the external power supply voltage, so as to elevate or lower the reference level in accordance with a level of the external power supply voltage.

In another embodiment, the second circuit includes a plurality of reference level adjusting transistors connected in parallel to each other between a power supply terminal and a reference potential line, the plurality of reference level adjusting transistors being selectively turned on or off on the basis of a level of the external power supply voltage.

With this arrangement, it is possible to finely adjust the reference level.

The above and other objects, features and advantages of the present invention will be apparent from the following description of preferred embodiments of the invention with reference to the accompanying drawings.

DESCRIPTION OF THE PREFERRED EMBODIMENTS

Figure 3:
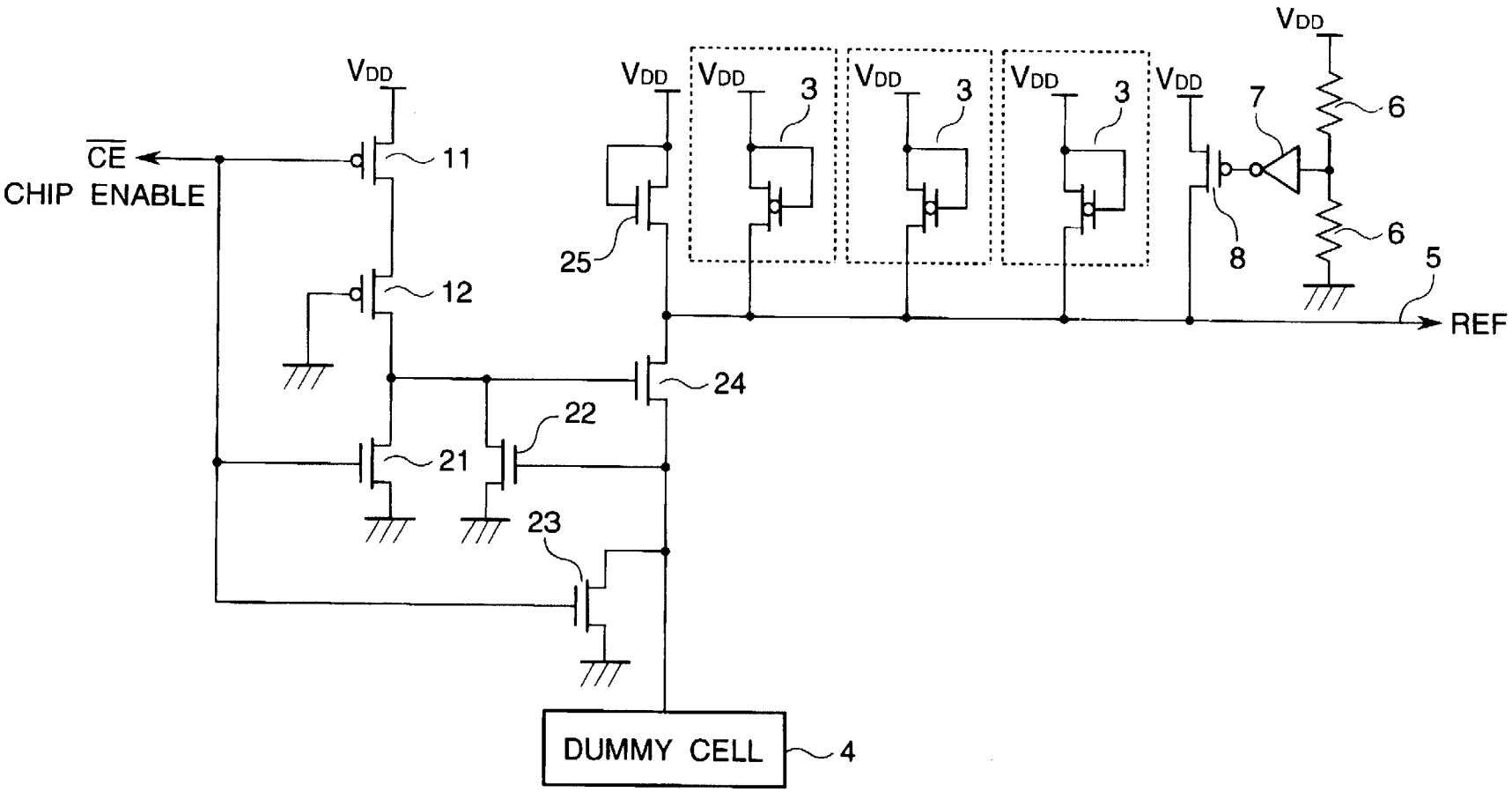
FIG. 3 is a circuit diagram of a first embodiment of the circuit in accordance with the present invention, for supplying a reference level to a differential sense amplifier incorporated in a semiconductor memory.

Referring to FIG. 3, there is shown a circuit diagram of a first embodiment of the circuit in accordance with the present invention, for supplying a reference level to a differential sense amplifier incorporated in a semiconductor memory. In FIG. 3, elements similar to those shown in FIG. 1 are given the same Reference Numerals, and explanation thereof will be omitted for simplification of description.

Figure 1:
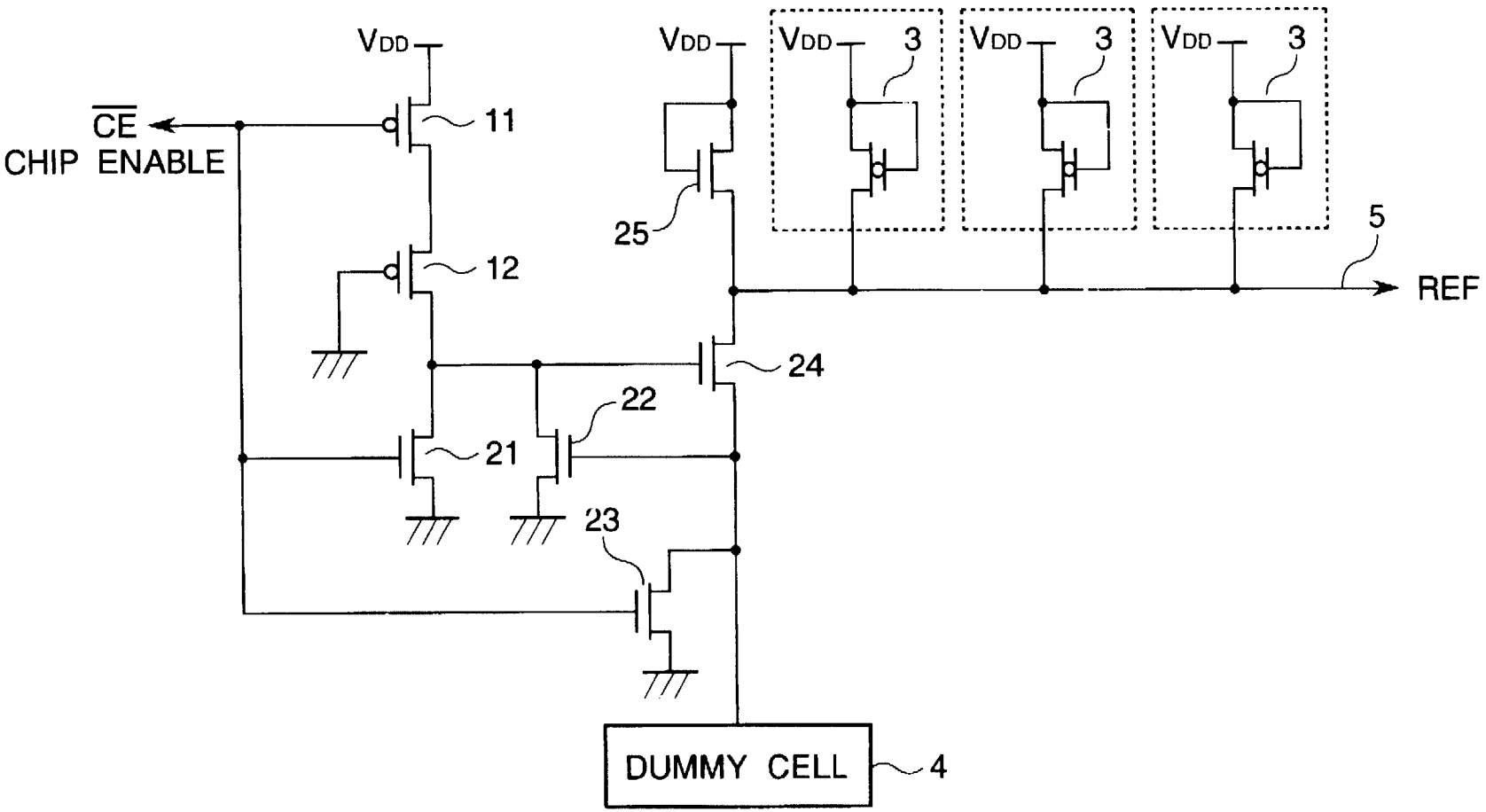
FIGURE 1 PRIOR ART
FIG. 1 is a circuit diagram of a conventional reference circuit for supplying a reference level to a differential sense amplifier incorporated in a semiconductor memory.

As seen from comparison between FIGS. 1 and 3, the shown embodiment includes, in addition to the circuit construction shown in FIG. 1, a pair of resistors 6 which are connected in series between the high potential power supply voltage $V_{DD}$ and the ground, and which can be formed of for example a diffusion layer or a polysilicon. The pair of resistors 6 form a voltage divider. A connection node between the pair of resistors 6 is connected to an input of an inverter 7, which in turn has an output connected to a gate of a reference level adjusting P-channel transistor 8 connected between the high potential power supply voltage $V_{DD}$ and the reference level output node 5. Thus, the load circuit is composed of not only the transistors 3 but also the transistor 8.

Now, operation of the first embodiment will be described.

The circuit is designed or set to the effect that, when the external power supply voltage $V_{DD}$ is the first power supply voltage (5 V), the gate of the reference level adjusting P-channel transistor 8 becomes a low level by action of the resistors 6 and the inverter 7, and when the external power supply voltage $V_{DD}$ is the second power supply voltage (3 V), the gate of the reference level adjusting P-channel transistor 8 becomes a high level by action of the resistors 6 and the inverter 7.

Figure 2A:
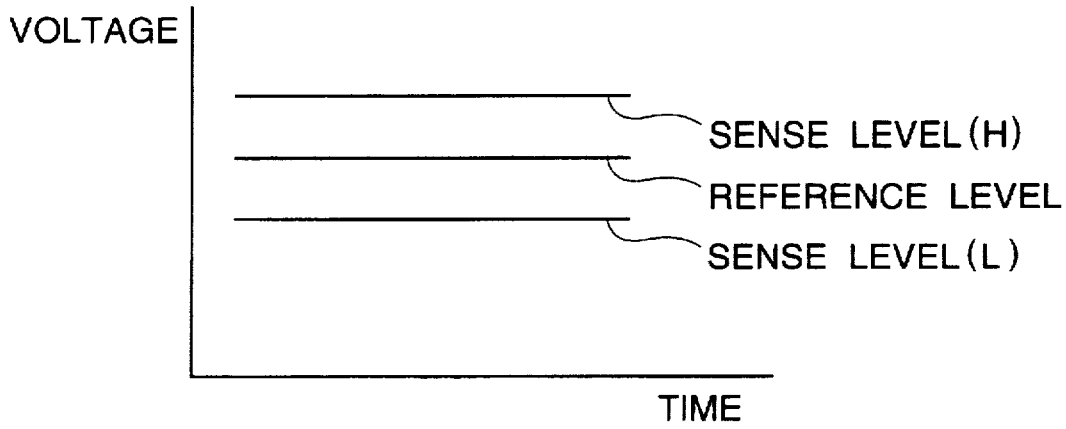
FIGS. 2A, 2B and 2C are graphs illustrating a relation between a reference level and a high level and a lower level of a sense level in the sense amplifier.
Figure 2B:
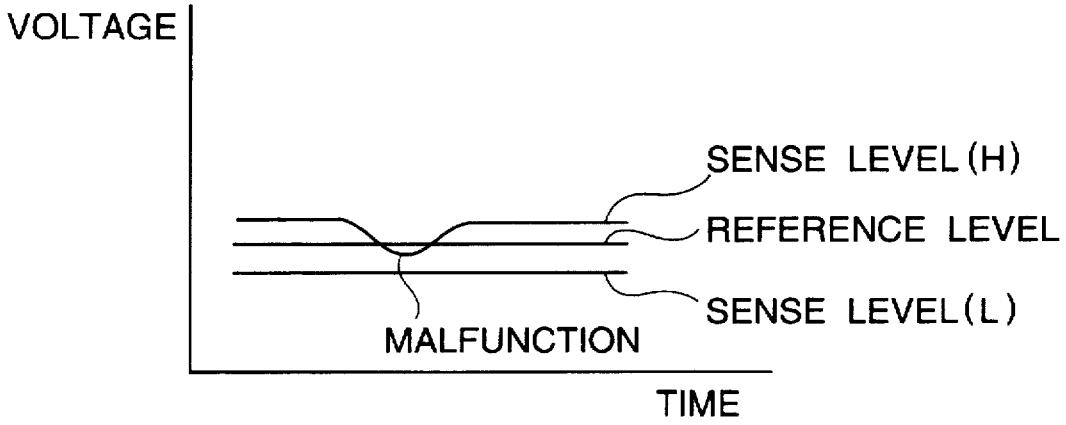

Therefore, when the external power supply voltage $V_{DD}$ is the first power supply voltage (5 V), the reference level adjusting P-channel transistor 8 is turned on, so that the load circuit is constituted of the transistors 3 and the transistor 8, and therefore, the driving capacity of the load circuit is large sufficient to maintain the reference level REF at an intermediate level between the high level (H) and the low level (L) of the sense level, as shown in FIG. 2A. Namely, the difference between the reference level REF and the high level (H) of the sense level is substantially equal to the difference between the reference level REF and the low level (L) of the sense level.

Figure 2C:
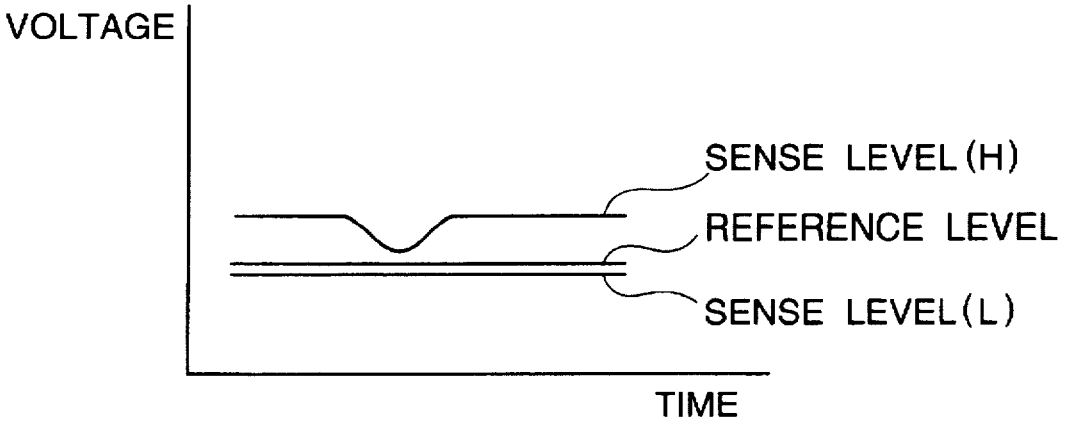

On the other hand, when the external power supply voltage $V_{DD}$ is the second power supply voltage (3 V), the reference level adjusting P-channel transistor 8 is turned off, so that the load circuit is constituted of only the transistors 3, and therefore, the driving capacity of the load circuit is small to lower the reference level REF. Accordingly, although the high level of the sense level drops by connecting the semiconductor memory to the second power supply voltage (3 V) as the external power supply voltage, the reference level REF is adjusted to a level sufficiently lower than the high level of the sense level, as shown in FIG. 2C which illustrates a relation between the reference level and each of the high level and the low level of the sense level when the shown embodiment is connected to the second power supply voltage (3 V). In other words, the difference between the reference level REF and the high level (H) of the sense level is clearly larger than the difference between the reference level REF and the low level (L) of the sense level. Therefore, the high level of the sense level never becomes lower than the reference level REF due to a noise or another cause, and accordingly, no malfunction occurs.

On the other hand, if there is an inclination that when the semiconductor memory is connected to the second power supply voltage (3 V) as the external power supply voltage, such a malfunction is apt to occur that the low level of the sense level momentarily becomes higher than the reference level REF, the reference level adjusting P-channel transistor 8 is replaced with an N-channel transistor, and the circuit is designed or set to the effect that, when the external power supply voltage is the second power supply voltage (3 V), the gate of the reference level adjusting N-channel transistor becomes a high level by action of the resistors 6 and the inverter 7 so as to elevate the reference level, and when the external power supply voltage is the first power supply voltage (5 V), the gate of the reference level adjusting N-channel transistor becomes a low level by action of the resistors 6 and the inverter 7. This arrangement can prevent the malfunction.

In this case, therefore, the circuit is so designed that, when the external power supply voltage $V_{DD}$ is the first power supply voltage (5 V), the reference level adjusting N-channel transistor is turned off, so that the load circuit is constituted of only the transistors 3, and therefore, the driving capacity of the load circuit is small, but the difference between the reference level REF and the high level (H) of the sense level is substantially equal to the difference between the reference level REF and the low level (L) of the sense level, and when the external power supply voltage $V_{DD}$ is the second power supply voltage (3 V), the reference level adjusting N-channel transistor is turned on, so that the load circuit is constituted of the transistors 3 and the reference level adjusting N-channel transistor, therefore, the driving capacity of the load circuit is large sufficiently to make the difference between the reference level REF and the low level (L) of the sense level clearly larger than the difference between the reference level REF and the high level (H) of the sense level.

Figure 4:
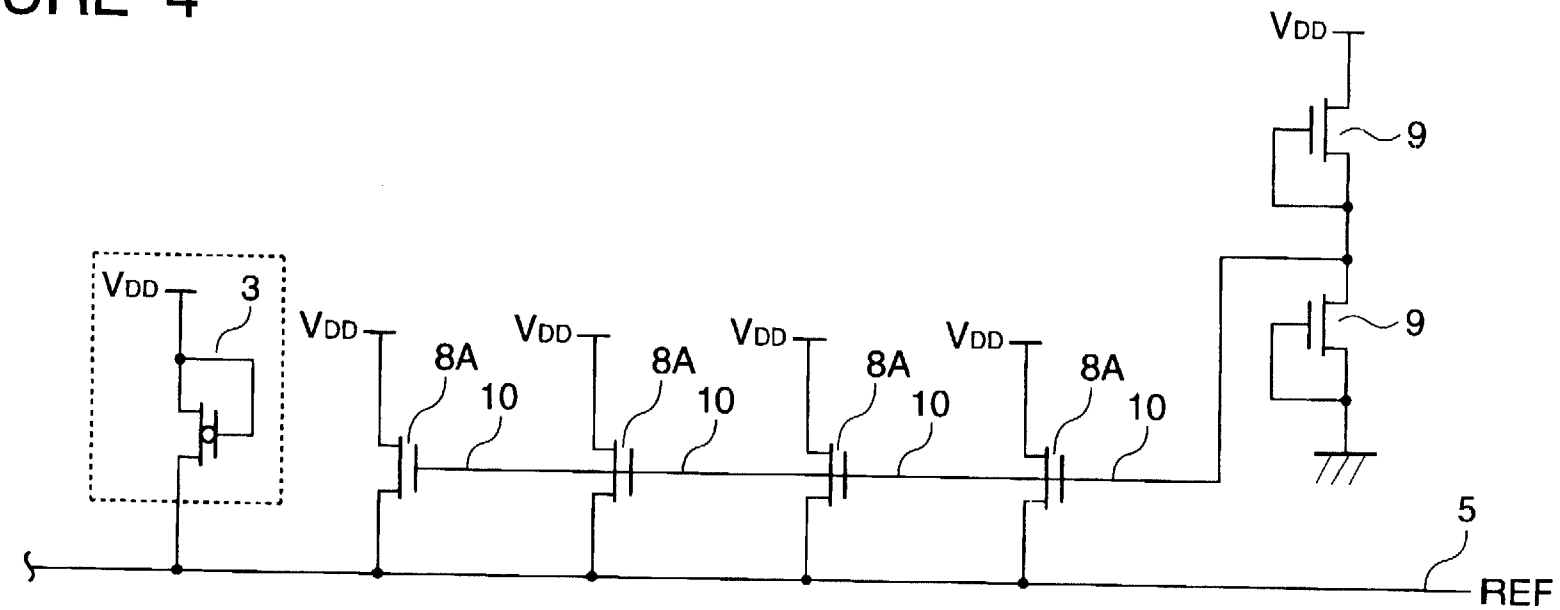
FIG. 4 is a circuit diagram of an essential part of a second embodiment of the circuit in accordance with the present invention, for supplying a reference level to a differential sense amplifier incorporated in a semiconductor memory.

Referring to FIG. 4, there is a circuit diagram of an essential part of a second embodiment of the circuit in accordance with the present invention, for supplying a reference level to a differential sense amplifier incorporated in a semiconductor memory. In FIG. 4, elements similar to those shown in FIG. 1 are given the same Reference Numerals, and explanation thereof will be omitted for simplification of description. The second embodiment is the same as the first embodiment, excepting for the portion composed of the elements 6, 7 and 8.

The second embodiment includes a plurality of reference level adjusting transistors 8A connected in parallel to each other between the high potential power supply voltage $V_{DD}$ and the reference level outputting node 5, and a pair of programming N-channel transistors 9 connected in series between the high potential power supply voltage $V_{DD}$ and the ground. Each of the pair of N-channel transistors 9 has a gate thereof connected to a source thereof. In addition, one of the pair of N-channel transistors 9 is of a depletion type, so as to determining an output level on a connection node between the pair of N-channel transistors 9. The pair of transistors 9 form a voltage divider. The connection node between the pair of N-channel transistors 9 is connected to a gate of each of the reference level adjusting transistors 8A through a wiring conductor 10, which is formed of for example an aluminum wiring which can be relatively easily cut or broken off. Thus, a load circuit is composed of the transistors 3 and the transistors 8A.

In the above mentioned arrangement, when the external power supply voltage $V_{DD}$ used is previously determined, the reference level adjusting transistors 8A are fixed either in an on condition or in an off condition, by action of the programming transistors 9, dependently upon whether the external power supply voltage $V_{DD}$ is the first power supply voltage (5 V) or the second power supply voltage (3 V), so that the reference level REF on the output node 5 is made constant.

In addition, since a plurality of reference level adjusting transistors 8A are provided in the second embodiment, it is possible to finely adjusting the reference level REF, by grounding the gate of a selected one or ones of the reference level adjusting transistors 8A in accordance with a voltage of the external power supply, for example by cutting the aluminum wiring conductor 10 and connecting the gate of the selected transistor or transistors to the ground.

The invention has thus been shown and described with reference to the specific embodiments. However, it should be noted that the present invention is in no way limited to the details of the illustrated structures but changes and modifications may be made within the scope of the appended claims.

I claim:

1. A circuit for supplying a reference level to a differential sense amplifier in a semiconductor memory circuit, the circuit including a first circuit for detecting an external power supply voltage, and a second circuit controlled by said first circuit, for controlling said reference level to be supplied to said differential sense amplifier, on the basis of the result of the detection of said external power supply voltage;

wherein said first circuit includes a voltage divider connected between said external power supply voltage and ground and wherein said second circuit includes at least one load transistor connected in the form of a load between said external power supply voltage and a reference level output node, an inverter having an input connected to an intermediate tap of said voltage divider, and at least one reference level adjusting transistor connected between said external power supply voltage and said reference level output node and having a control electrode connected to an output of said inverter, so that when said external power supply voltage is a first power supply voltage, said at least one reference level adjusting transistor is turned on, so that a load circuit is constituted of said at least one load transistor and said at least one reference level adjusting transistor, and therefore said load circuit has an increased current driving capacity to maintain such a relation that a difference between said reference level and a high level of a sense level is substantially equal to the difference between said reference level and a low level of said sense level, and when said external power supply voltage is a second power supply voltage lower than said first power supply voltage, said at least one reference level adjusting transistor is turned off, so that said load circuit is constituted of only said at least one load transistor, and therefore said load circuit has a decreased current driving capacity to lower said reference level, whereby the difference between said reference level and said high level of said sense level is clearly larger than the difference between said reference level and said low level of said sense level.

2. A circuit for supplying a reference level to a differential sense amplifier in a semiconductor memory circuit, the circuit including a first circuit for detecting an external power supply voltage, and a second circuit controlled by said first circuit, for controlling said reference level to be supplied to said differential sense amplifier, on the basis of the result of the detection of said external power supply voltage;

wherein said first circuit includes a voltage divider connected between said external power supply voltage and ground and wherein said second circuit includes at least one load transistor connected in the form of a load between said external power supply voltage and a reference level output node, an inverter having an input connected to an intermediate tap of said voltage divider, and at least one reference level adjusting transistor connected between said external power supply voltage and said reference level output node and having a control electrode connected to an output of said inverter, so that when said external power supply voltage is a first power supply voltage, said at least one reference level adjusting transistor is turned on, so that a load circuit is constituted of only said at least one load transistor, and therefore said load circuit has a decreased current driving capacity to maintain such a relation that a difference between said reference level and a high level of a sense level is substantially equal to the difference between said reference level and a low level of said sense level, and when said external power supply voltage is a second power supply voltage lower than said first power supply voltage, said at least one reference level adjusting transistor is turned on, so that said load circuit is constituted of said at least one load transistor and said at least one reference level adjusting transistor, and therefore said load circuit has an increased current driving capacity to elevate said reference level, whereby the difference between said reference level and said low level of said sense level is clearly larger than the difference between said reference level and said high level of said sense level.

3. A circuit for supplying a reference level to a differential sense amplifier in a semiconductor memory circuit, the circuit including a first circuit for detecting an external power supply voltage, and a second circuit controlled by said first circuit, for controlling said reference level to be supplied to said differential sense amplifier, on the basis of the result of the detection of said external power supply voltage;

wherein said second circuit includes a plurality of reference level adjusting transistors connected in parallel to each other between said external power supply voltage and a reference potential line, said plurality of reference level adjusting transistors being selectively turned on or off on the basis of a level of said external power supply voltage.

4. A circuit for supplying a reference level to a differential sense amplifier in a semiconductor memory circuit, the circuit including a first circuit for detecting an external power supply voltage, and a second circuit controlled by said first circuit, for controlling said reference level to be supplied to said differential sense amplifier, on the basis of the result of the detection of said external power supply voltage;

wherein said first circuit includes a voltage divider connected between said external power supply voltage and ground and wherein said second circuit includes at least one load transistor connected in the form of a load between said external power supply voltage and a reference level output node, and a plurality of reference level adjusting transistors connected in parallel to each other between said external power supply voltage and said reference level output node, each of said plurality of reference level adjusting transistors having a control electrode connected to an intermediate tap of said voltage divider through a wiring conductor, said plurality of reference level adjusting transistors being selectively turned on or off on the basis of a level of said external power supply voltage, by cutting said wiring conductor.

* * * * *